United States Patent [19]

Lam

[11] Patent Number: 4,989,677

[45] Date of Patent: Feb. 5, 1991

[54] PILE DRIVING

[75] Inventor: Heng B. Lam, Petaling Jaya, Malaysia

[73] Assignees: Precast Micro Injection; Pile Technology Limited, both of Hong Kong

[21] Appl. No.: 21,410

[22] Filed: Mar. 4, 1987

[30] Foreign Application Priority Data

Mar. 7, 1986 [GB] United Kingdom ..... 8605652
Oct. 13, 1986 [GB] United Kingdom ..... 8624515

[51] Int. Cl.[5] ..... E21C 9/00

[52] U.S. Cl. ..... 173/31; 173/1; 173/22; 173/81; 405/232

[58] Field of Search ..... 173/1, 22, 32, 26, 81, 173/82, 83, 53, 31; 405/232

[56] References Cited

U.S. PATENT DOCUMENTS 2,287,059 6/1942 Platts et al. ..... 173/32
3,314,241 4/1967 Mayhall ..... 173/1
4,040,492 8/1977 Frederick ..... 173/1
4,058,175 11/1977 Holland ..... 173/1
4,627,769 12/1986 Lee ..... 405/232 X

FOREIGN PATENT DOCUMENTS 150801 6/1971 U.S.S.R. ..... 173/26

*Primary Examiner*—Frank T. Yost
*Assistant Examiner*—Willmon Fridie, Jr.
*Attorney, Agent, or Firm*—Fleit, Jacobson, Cohn, Price, Holman & Stern

[57] ABSTRACT

A pile 13 is driven into the ground 5 by a ram 8 driven by a hydraulic cylinder 37. The pile 13 is guided through a guide 2 having a detachable end portion 4 which is embedded in the ground. The guide 2 and cylinder 37 are vertically slideable on a rail 3 and can be raised and lowered by a further hydraulic ram 39 located at the upper end of the rail 3. Further piles are loaded through a door 11 in the side of the guide 2 and each pile is driven in a single stroke. The apparatus is transportable on a tracked vehicle 41. By supporting the pile 13 in a tubular guide 2 during driving it is possible to use pile sections of small diameter which are light and easy to handle. Pile sections are connected using a tubular metal joint member.

29 Claims, 4 Drawing Sheets

PILE DRIVING

Figure 1:
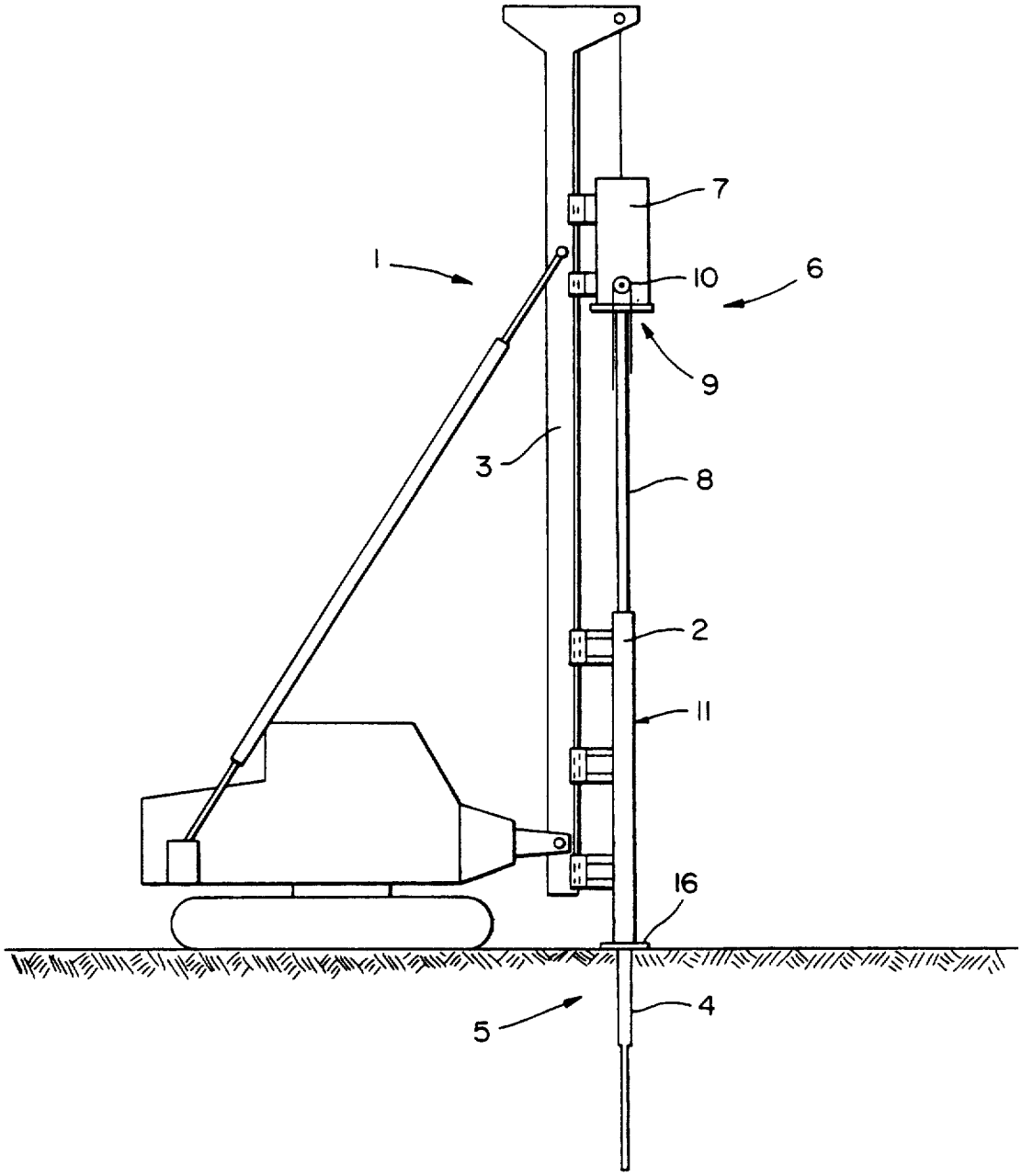

This invention relates to pile driving and in particular but not exclusively to driving precast concrete piles.

According to the present invention there is disclosed a method of pile driving in which the pile is driven by a reciprocating drive means and is progressively extended in length by connecting additional pile sections at the driven end of the pile between successive driving strokes of the drive means.

An advantage of such a method is that a pile may be assembled from relatively short pile sections which are relatively easy to handle and consequently may be of relatively small cross section since the pile sections do not need to withstand the bending stresses experienced by longer lengths of pile during handling. Since a pile section of relatively small cross section is being driven the need for hammering is obviated and each section of the pile is driven by a single continuous driving stroke of the drive means.

Preferably the pile is driven in a guide for substantially preventing bending of the driven portion of the pile adjacent the driven end. Preferably a detachable end portion of the guide is embedded in the ground being worked. An advantage of such an end portion is that it may be embedded in the ground prior to connection with the guide so as to facilitate accurate location of the pile site and support the guide during pile driving.

Preferably adjacent pile sections are joined together by means of a tubular joint member and conveniently the pile sections are adhesively bonded to the joint member.

According to a further aspect of the invention there is disclosed apparatus for use in pile driving comprising a tubular guide for receiving the pile and reciprocating drive means including a ram for driving the pile through the guide such that the driven portion of the pile adjacent the driven end is substantially prevented from bending.

Preferably the guide includes a detachable end portion for embedding in the ground being worked and conveniently a side wall of the guide includes an access door for introducing a pile section into the guide for connection to the pile.

Conveniently the drive means include a weight attached to the ram for driving the ram in a downward direction during the driving stroke and lifting means for lifting the weight during the return stroke.

Conveniently the apparatus includes auxiliary drive means for further urging the ram downwards during the driving stroke.

Advantageously the weight is slideable on a rail which extend substantially vertically in use and the guide is attached to a lower portion of the rail.

Alternatively there is disclosed pile driving apparatus wherein the ram is hydraulically powered by means of a hydraulic cylinder connected to the guide.

Preferably the cylinder and guide are slideable on a rail, which rail extends substantially vertically in use.

Advantageously the apparatus comprises a further hydraulic ram operable between the rail and the cylinder whereby in use the cylinder and guide may be urged upwardly or downwardly along the rail.

According to a further aspect of the present invention there is disclosed a concrete pile section for use in a method as hereinbefore disclosed and comprising an elongate member having a middle portion of uniform cross section and end portions of reduced cross section for fitting into a tubular connector such that when connected to the pile section the longitudinally extending surface of the connector is flush with that of the pile section.

Advantageously the pile sections may include a longitudinally extending bar providing reinforcement and conveniently the bar may be prestressed.

Figure 2:
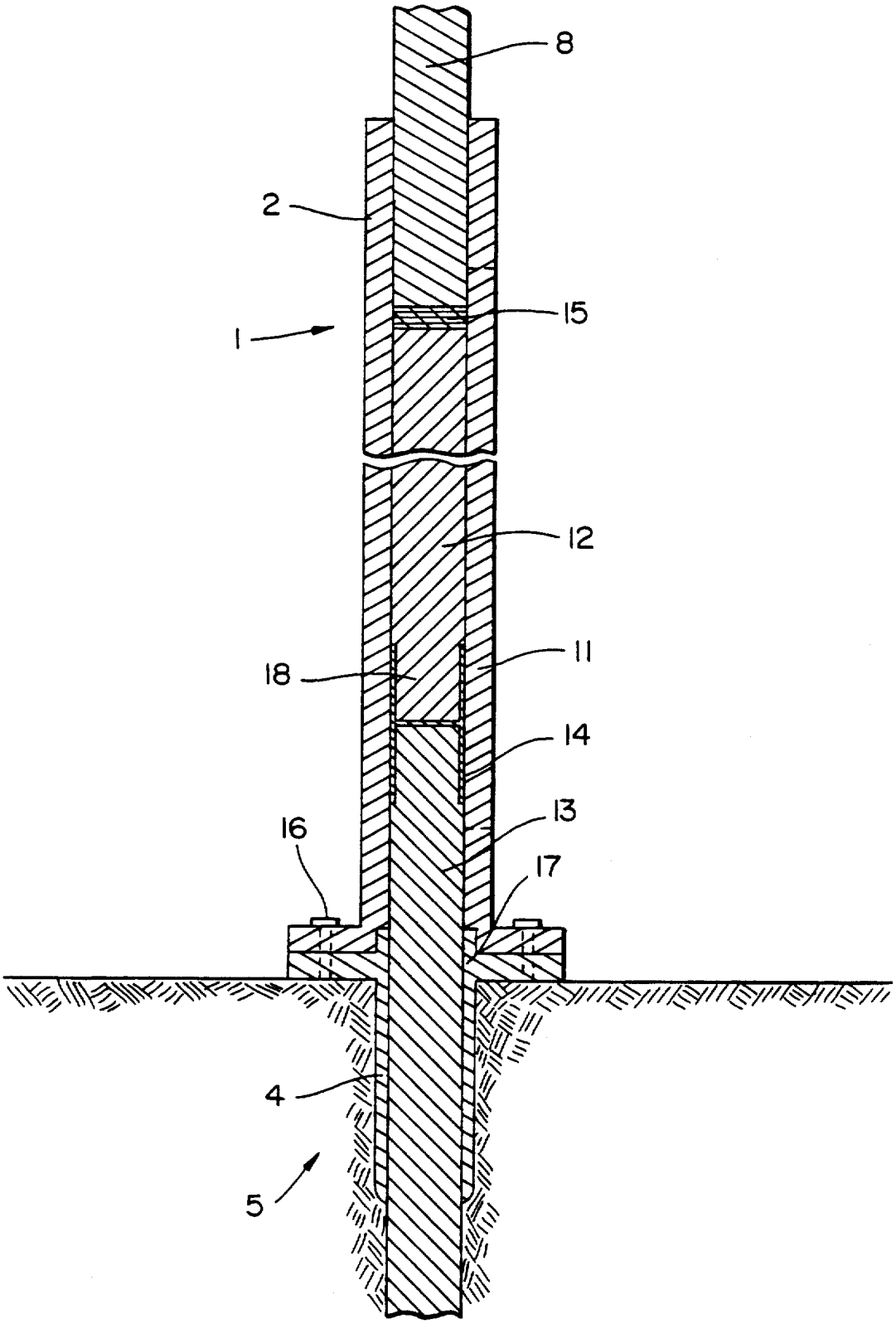
Figure 3:
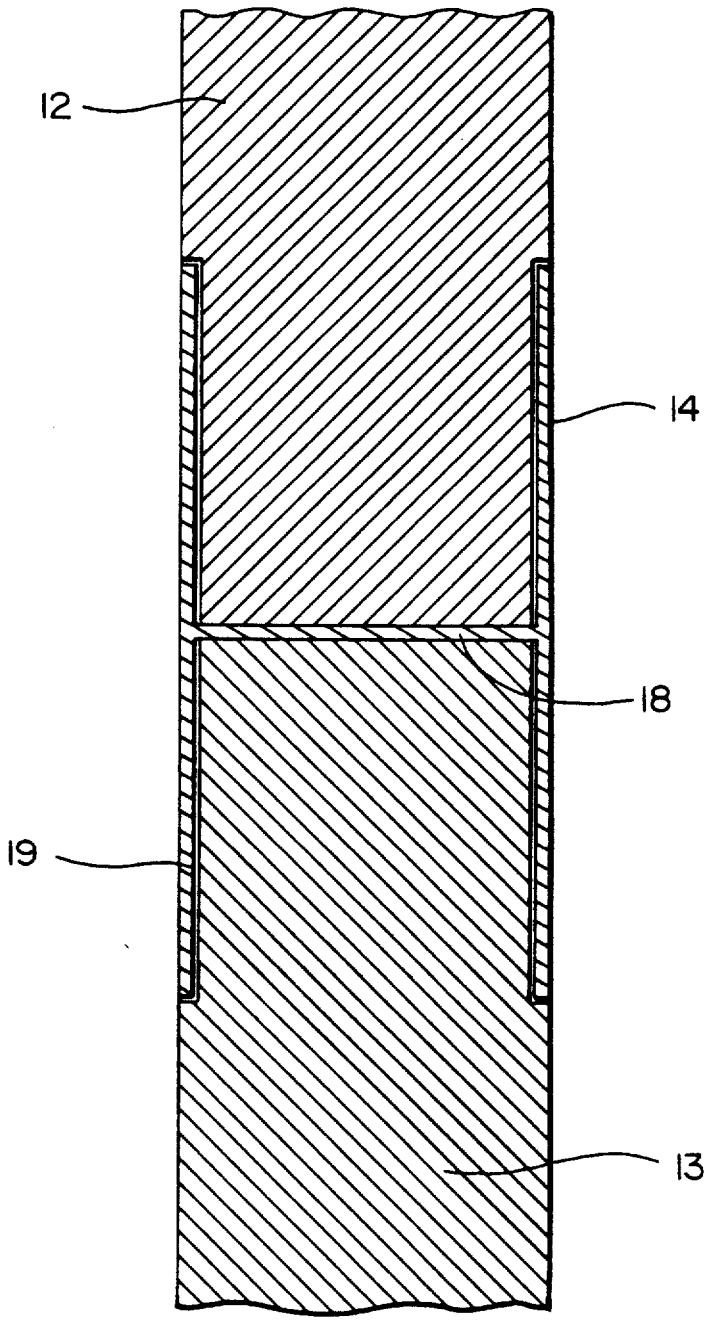
Figure 4:
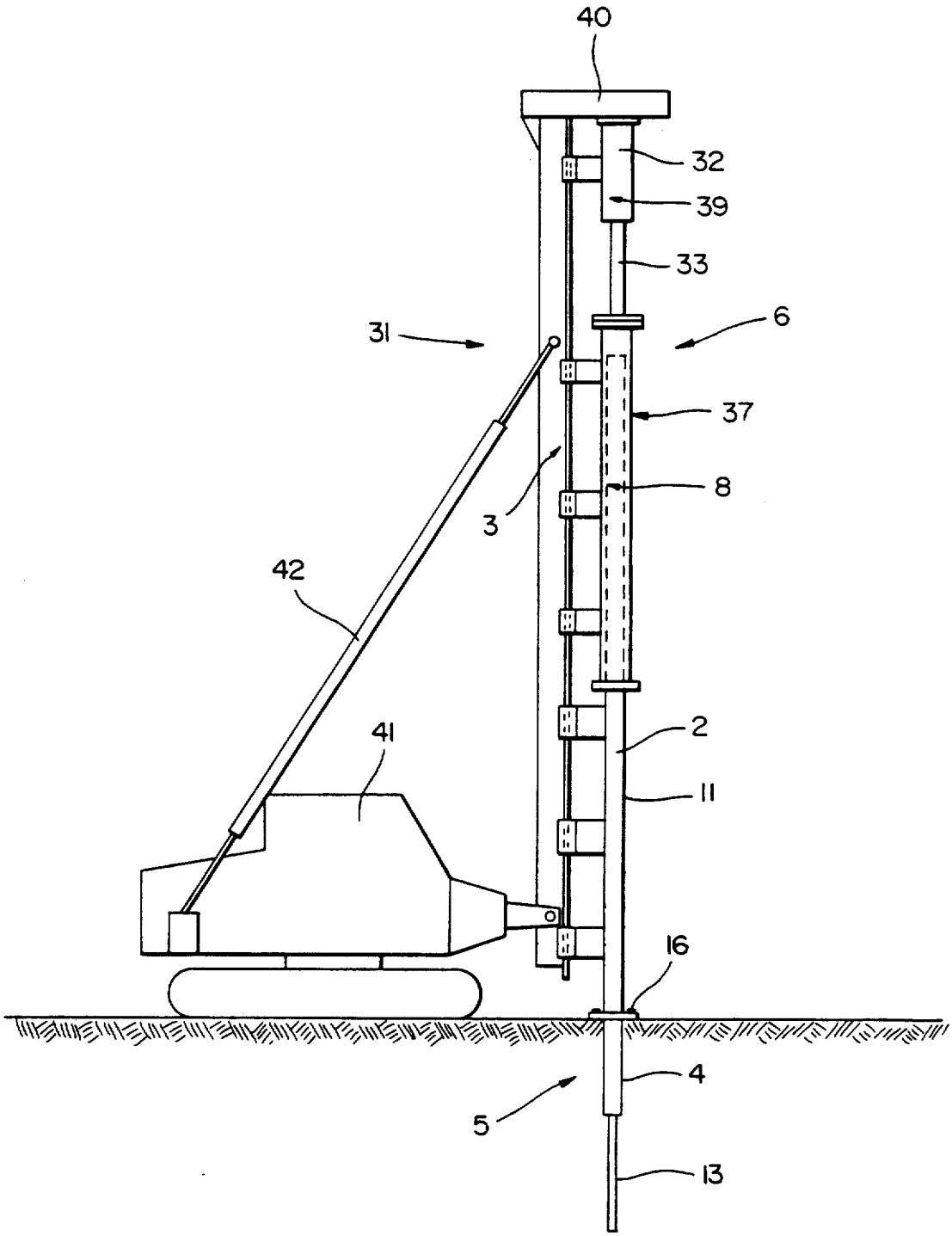

Particular embodiments of the invention will now be described by way of example only and with reference to the accompanying drawings of which FIG. 1 is an elevation of pile driving apparatus mounted on a tracked vehicle FIG. 2 is an enlarged sectional elevation of a guide receiving a pile, FIG. 3 is a sectional elevation of a connection between adjacent piles, and FIG. 4 is an elevation of an alternative pile driving apparatus having a hydraulically driven ram.

The pile driving apparatus 1 of FIG. 1 has a guide 2 mounted on a vertically extending rail 3, the guide having a detachable end portion 4 embedded in the ground being worked 5. A reciprocating drive 6 includes a weight 7 attached to a ram 8 with an auxiliary power drive 9 including a motor (not shown) connected to the weight 7 by a pulley system 10.

The guide 2 has a door 11 through which a concrete pile section may be loaded.

FIG. 2 shows pile sections 12 and 13 received within the guide 2 and joined by a joint member 14. A timber pad 15 is inserted between the uppermost pile section 12 and the ram 8 to avoid damage to the pile section during driving. The end portion 4 of the guide 2 is attached by bolts 16 and is positively located by means of a flange 17.

FIG. 3 shows adjacent pile sections 12 and 13 joined by the joint member 14. A layer of quick setting epoxy film 19 is interposed between the pile sections and the joint member to form an adhesive bond.

In the example shown the pile sections are of 3" diameter and the joint member 14 receives each pile section to a depth of 3". The joint member 14 is formed from ⅛" thick mild steel pipe with a partition 18 at its mid point. In order to drive a deep pile the end portion 4 of the guide 2 is first driven into the ground at the precise location required and the guide 2 assembled with the end portion by means of the bolts 16. A pile section 13 is then loaded into the guide 2 through the door 11 together with the timber pad 15 and the door is closed. The ram 8 is then driven downwardly through the guide 2 by a driving stroke of the driven means 6 in which the weight 7 pushes downward on the ram 8 assisted by the auxiliary power drive 9.

Each pile section 12, 13 may alternatively includes a reinforcing bar extending centrally and longitudinally along the bar. This bar may be prestressed as required.

When the upper end of the pile section 12 is at a convenient height the ram 8 is raised and a further pile section 12 introduced into the guide through the door 11 and is joined to the lower pile section 13 by means of a joint member 14. The driving process is then repeated and further pile sections added as required until the required total length of pile has been driven. The last pile section to be driven may conveniently be driven so as to the be flushed with the ground surface and the end portion 4 of the guide 2 removed for reuse.

An alternative pile driving apparatus 31 is shown in FIG. 4 in which components corresponding to the apparatus 1 of FIG. 1 are correspondingly numbered where appropriate. The pile driving apparatus 31 of FIG. 4 includes a hydraulic cylinder 37 in which the ram 8 is reciprocatingly received. The hydraulic cylinder 37 is bolted onto the upper end of the guide 2 so as to be in line with the guide thereby enabling the ram 8 to slide vertically from one to the other. The hydraulic cylinder and the guide 2 are both slideably mounted on a vertical rail 3 so as to be moveable in unison upward or downward along the rail as required.

A further hydraulic ram 39 is provided at the upper end of the cylinder 37 and comprises a further hydraulic cylinder 32 connected to a horizontal projection 40 of the rail and to a piston rod 33 connected to the cylinder 37. By extending the further ram 39 the cylinder 37 and hence the guide 2 are driven downwards along the rail 3. Conversely when the further ram 39 is retracted the cylinder 37 and the guide 2 are raised.

The rail is supported on a tracked vehicle 41 from which it may be raised into the vertical position for use in pile driving or lowered into an inclined or horizontal position for transit by means of a jack 42.

In use to drive a pile 13 into the ground 5, the vehicle 41 is positioned at the required site with the rail 3 in the vertical position and with the further hydraulic ram 39 in the retracted condition so that both the cylinder 37 and the guide 2 are raised. The detached end portion 4 of the guide is driven into the ground at the required site for pile penetration and the guide 2 is lowered so as to connected with the end portion 4. The guide 2 and cylinder 37 are lowered by allowing the further hydraulic ram 39 to extend. The guide 2 is bolted to the end portion of the guide 4 and a pile section 13 loaded into the guide 2 through the door 11. The door 11 is closed to seal the guide 2 and the further hydraulic ram 39 actuated by hydraulic power to urge the cylinder 37 and guide 2 in a downward direction into positive engagement with the ground 5. In this way the weight of the vehicle 41 is used to bias the guide 2 into positive contact with the ground. To commence pile driving the hydraulic cylinder 37 is actuated by hydraulic power to urge the ram 8 in a downward direction thereby forcing the pile section 13 into the ground through the guide 2 and the end portion of the guide 4 in a single stroke.

At the end of the stroke of the ram 8 the hydraulic cylinder 37 is reversed actuated to raise the ram 8 and a further pile section is loaded into the guide 2 through the door 11. The new pile section is joined to the previously driven pile section as described above.

The cycle is repeated until a sufficent number of pile sections has been driven into the ground following which the guide 2 is detached from the end portion 4 and raised for relocation at another site.

The cross section of the concrete pile may be square or circular or any other convenient shape and satisfactory results may be obtained using piles up to b 7" in diameter. The concrete pile may be less than 6 inches in width. The weight may typically be a 10 ton mass but should be 2 to 3 times the working load of the pile depending on the ground conditions.

The end portion 4 of the guide 2 also serves to prevent tilting of the guide during pile driving operations and the required length of this end portion will depend in practice on the hardness of the surface layer of the ground being worked.

The ram is made of a high tensile steel which may be further reinforced by strengthening brackets (not shown).

A particular advantage of the apparatus and method disclosed above is that the need for hammering is obviated so that noise and vibration are substantially reduced. The cost of pile driving is also reduced since relatively small pile sections are more convenient to transport to the site and generally will not require cutting to length.

A further advantage is that piles of small cross section can be used in this method thereby saving costs in production and handling of the piles. Previously known systems of pile driving has necessarily used piles of much greater cross section in order to withstand hammering impacts and this has incurred penalties in terms of handling costs and production.

I claim:

1. Apparatus for use in pile driving, comprising:
tubular guide means for receiving the pile;
reciprocating means including a ram, for driving the pile through the guide means such that a driven portion of the pile adjacent to a driven end is substantially prevented from bending;
a weight attached to the ram for driving the ram in a downward direction during a driving stroke and lifting means for lifting the weight during a return stroke; and
auxiliary drive means positioned above and connected to said reciprocating means, for further urging the ram downwards during the driving stroke.

2. Apparatus as claimed in claim 1 in which the guide means includes a detachable end portion for embedding in earth being worked.

3. Apparatus as claimed in claim 1 in which a side wall of the guide means includes an access door for introducing pile section into the guide means for connection to the pile.

4. Apparatus as claimed in claim 1, further comprising a rail, whereby the weight is sideable on the rail, which rail extends substantially vertically in use and the guide means is attached to a lower portion of the rail.

5. The apparatus of claim 1, wherein the guide means includes a detachable end portion capable of being embedded into ground receiving the pile from the apparatus.

6. The apparatus of claim 1, wherein the guide means includes an end portion detachable from said guide means and disposed along said guide means opposite from said ram, said detachable end portion being capable of being embedded into ground receiving the pile from the apparatus.

7. The apparatus of claim 1, wherein said guide means includes a side wall and a door providing access permitting a pile to be introduced into said guide means through said side wall.

8. The apparatus of claim 5, wherein said guide means includes a side wall and an access door permitting a pile to be introduced into said guide means through said side wall.

9. The apparatus of claim 6, wherein said guide means includes a side wall and an access door permitting a pile to be introduced into said guide means through said side wall.

10. Apparatus for use in pile driving, comprising:
tubular guide means for receiving the pile;
reciprocating drive means including a first ram, for driving the pile through the guide means such that a driven portion of the pile adjacent a driven end is substantially prevented from bending;

hydraulic cylinder means connected to the guide means, for hydraulically powering the ram;

a rail extending vertically while in use, sideably engaged by said hydraulic cylinder means and said guide means; and a hydraulic ram operable between the rail and the cylinder means whereby in use the cylinder means and guide means may be urged upwardly along the rail.

11. A concrete pile section for use in an apparatus as claimed in either claim 1 or claim 10 comprising an enlongate member having a middle portion of uniform cross section and end portions of reduced cross section for fitting into a tubular connector such that when connected to the pile a longitudinally extending surface of the connector is flush with the pile.

12. A concrete pile section as claimed in claim 11 and further comprising a reinforcing bar extending longitudinally within the pile section.

13. A concrete pile section as claimed in 12 wherein the bar is prestressed.

14. A concrete pile section as claimed in any of claim 11 having a width less than or equal to 6 inches.

15. The apparatus of claim 10, wherein the guide means includes a detachable end portion capable of being embedded into ground receiving the pile from the apparatus.

16. The apparatus of claim 10, wherein the guide means includes an end portion detachable from said guide means and disposed along said guide means opposite from said ram, said detachable end portion being capable of being embedded into ground receiving the pile from the apparatus.

17. The apparatus of claim 10, wherein said guide means includes a side wall and a door providing access permitting a pile to be introduced into said guide means through said side wall.

18. The apparatus of claim 15, wherein said guide means includes a side wall and an access door permitting a pile to be introduced into said guide means through said side wall.

19. The apparatus of claim 16, wherein said guide means includes a side wall and an access door permitting a pile to be introduced into said guide means through said side wall.

20. Apparatus for use in pile driving, comprising:

tubular guide means for receiving a pile;

reciprocating means including a ram, for driving the pile through the guide means whereby a driven portion of the pile adjacent to a driven end of the pile is substantially prevented from bending;

means attached to the ram, for driving the ram in a downward direction during a driving stroke and for lifting the driving means during a return stroke; and auxiliary means positioned above and connectable to said reciprocating means, for further urging the ram downwards during the driving stroke.

21. The apparatus of claim 20, further comprised of:

a rail engaged by said guide means and driving means, and slideably engaged by said auxiliary means.

22. The apparatus of claim 20, wherein the guide means includes a detachable end portion capable of being embedded into ground receiving the pile from the apparatus.

23. The apparatus of claim 20, wherein the guide means includes an end portion detachable from said guide means and disposed along said guide means opposite from said ram, said detachable end portion being capable of being embedded into ground receiving the pile from the apparatus.

24. The apparatus of claim 20, wherein said guide means includes a side wall and a door providing access permitting a pile to be introduced into said guide means through said side wall.

25. The apparatus of claim 22, wherein said guide means includes a side wall and an access door permitting a pile to be introduced into said guide means through said side wall.

26. The apparatus of claim 23, wherein said guide means includes a side wall and an access door permitting a pile to be introduced into said guide means through said side wall.

27. The apparatus of claim 21, wherein said guide means includes a side wall and a door providing access permitting a pile to be introduced into said guide means through said side wall.

28. The apparatus of claim 21, wherein the guide means includes a detachable end portion capable of being embedded into ground receiving the pile from the apparatus.

29. The apparatus of claim 21, wherein the guide means includes an end portion detachable from said guide means and disposed along said guide means opposite from said ram, said detachable end portion being capable of being embedded into ground receiving the pile from the apparatus.

* * * * *